United States Patent [19]

Nishida et al.

[11] Patent Number: 4,577,915

[45] Date of Patent: Mar. 25, 1986

[54] REFRIGERATOR CABINET

[75] Inventors: Susumu Nishida, Katano; Seiji Kimura, Yao; Akio Kobayashi; Tadashi Fuchigami, both of Hirakata, all of Japan

[73] Assignee: Sanyo Electric Co., Ltd., Japan

[21] Appl. No.: 503,848

[22] Filed: Jun. 13, 1983

[30] Foreign Application Priority Data

Jun. 15, 1982 [JP] Japan ..... 57-103159
Apr. 20, 1983 [JP] Japan ..... 58-70297

[51] Int. Cl.[4] ..... E65D 25/14
[52] U.S. Cl. ..... 312/214; 220/62
[58] Field of Search ..... 220/62, 444, 467; 312/214

[56] References Cited

U.S. PATENT DOCUMENTS

| | | | |
|---|---|---|---|
| 2,031,701 | 2/1936 | Forsthoefel | 220/467 |
| 2,855,636 | 10/1958 | Donnelly | 220/462 |
| 3,165,221 | 1/1965 | Kasady | 220/444 |
| 3,883,198 | 5/1975 | Tillman | 220/467 |
| 4,078,690 | 3/1978 | Goettl | 220/62 |

FOREIGN PATENT DOCUMENTS

| | | | |
|---|---|---|---|
| 1362178 | 4/1964 | France | 220/467 |

*Primary Examiner*—William E. Lyddane
*Assistant Examiner*—Joseph Falk
*Attorney, Agent, or Firm*—Darby & Darby

[57] ABSTRACT

A refrigerator cabinet having an outer box comprised of a top wall and both side walls which are formed by bending one steel sheet that has been previously coated with paint, wherein one of front flanges adjacent to each other at the upper corner or corners of the outer box at least on the unsupported side of the door is bent along an inclined reference line extending from the corner to form a bent portion while at the same time forming a predetermined space on its rear side, the other of the front flanges is bent along said inclined reference line to form a stepped portion, and said bent portion is laid on top of the stepped portion, whereby the front surfaces of the front flanges adjacent to each other at said corner or corners are substantially flush with each other to come into sealing engagement with a door seal strip formed on a door.

10 Claims, 15 Drawing Figures

18
22
16
20
19
23
18
26
25

22
16
18
23
18
26
25

22
16
18
19
23
23
18
26
25
23

18
18
23
22
23

REFRIGERATOR CABINET

FIELD OF THE INVENTION

The present invention relates to a refrigerator cabinet and, more particularly, to an upper corner joint structure for connecting together front flanges which are formed upon the fringe of the outer box of such a cabinet surrounding the entrance to the box and with which a door seal strip comes into sealing engagement.

BACKGROUND OF THE INVENTION

The most basic function of refrigerators is to preserve food at a low temperature such that it can be taken out therefrom. For this purpose, a refrigerator is generally comprised of, for example, a body, a heat insulating door hinged to the body so as to be capable of opening and closing the entrance to the body, and a seal strip formed on the door and coming into sealing engagement with the fringe of the body surrounding the entrance to the body when the door is closed. The body consists of an outer box and an inner box, a heat insulating layer filled in a space formed between the boxes. The seal strip formed on the cabinet acts to prevent the cooled air in the body from leaking when the door is closed.

Of course, the leakage of the cooled air cannot be sufficiently prevented by the seal strip unless the fringe of the body which surrounds the entrance to the body and with which the seal strip comes into sealing engagement is uniform. Usually, the fringe of the body of a refrigerator surrounding the entrance to the body is provided with front marginal flanges for the top wall and the both side walls of its outer box, respectively, each front flange bending inwardly to right angles. Accordingly, making the fringe surrounding the entrance uniform depends to a large measure on the manner in which the front flange on the top wall is connected to the neighboring front flanges on the side walls at the abutting corners.

In a conventional refrigerator as disclosed in Japanese Utility Model Publication No. 12755/1971, one of the front flange on the top wall and each front flange on the side walls is offset so that the other may be placed on the one front flange. Then, the portions stacked on top of each other are centrally connected together by spot-welding. During this welding operation, a pressure is applied to some portions of the overlapping front flanges, and therefore there arises a possibility that the front end portion of the overlying flange is bent back toward the front, whereby the fringe is made nonuniform. Further, because such a front end portion is formed by cutting out a steel sheet and because it is used around the entrance that users most frequently touch, they might be hurt thereby. Furthermore, the prior art refrigerator cannot be fabricated from a flat steel sheet already coated with paint, whether it has been blanked or not. Consequently, a steel sheet cannot be coated before it is bent into a three-dimensional outer box and spot-welded as described above. Thus, inefficient spraying operation is required.

Another kind of refrigerator has been proposed as by Japanese Utility Model Laid-Open Nos. 100988/1980 and 90752/1979, in which the front flange on the top wall is opposed to the front flanges of the sides walls with a space therebetween at each corner. The opposing ends are offset or stepped, and a corner piece of synthetic resin is inserted in the space so that the space is sealed and the end portions of the neighboring flanges are flush with each other, and then they are joined together.

The refrigerator described just above is advantageous in that its outer box can be formed out of a flat steel sheet already coated with paint. However, it is difficult to hold neighboring flanges in flush state, because they do not overlap directly. Another problem is that the number of components as well as the number of steps needed to fabricate it is large.

SUMMARY OF THE INVENTION

Chiefly in view of the foregoing, it is a principal object of the present invention to provide a refrigerator cabinet having front flanges which are formed on the fringe of its outer box surrounding the entrance to the outer box so as to be adjacent to each other at the upper corners of the outer box, allowing a door seal strip to come into sealing engagement with them, and which can be made flush with each other with greater certainty.

It is another object of the invention to provide a safe outer box for a refrigerator in which surfaces formed by cutting a steel sheet from which the box is made are not exposed at the upper corners between front flanges.

It is a further object of the invention to provide an outer box for a refrigerator in which the fringe of the outer box surrounding the entrance to the outer box, particularly its upper corners, is made beautiful by a less number of components and a less number of operations, in view of the fact that those corners are most conspicuous when the door of the refrigerator is opened.

These objects are achieved by a refrigerator cabinet having the body of the cabinet, a heat insulating door hinged to the body for opening and closing the entrance to the body, and a door seal strip formed on the door and coming into sealing engagement with the periphery of the entrance when the door is closed, the body consisting of an outer box, an inner box and a heat insulating layer filled in a space formed between the boxes, the cabinet being characterized in that (A) the outer box is comprised of a top wall and both side walls which are formed by bending one steel sheet that has been previously coated with paint, (B) the front fringe of each of the walls has a front flange bending inwardly to right angles, a turnover flange bent back rearwardly of the front flange leaving a predetermined space $D_1$ between the turnover flange and the front flange, and a rear bent flange bent further rearwardly of the turnover flange leaving a space between the rear flange and the turnover flange for receiving the front fringe of the inner box surrounding the entrance to the inner box, the front flange having a front surface with which the door seal strip comes into sealing engagement, (C) one of the front flanges adjacent to each other at the upper corner or corners of the outer box at least on the unsupported side of the door is bent along an inclined reference line extending from the corner to form a bent portion while at the same time forming a predetermined space $D_2$ on its rear side, (D) the other of the front flanges is bent along said inclined reference line to form a stepped portion, and that (E) said bent portion is laid on top of the stepped portion, whereby the front surfaces of the front flanges adjacent to each other at said corner or corners are substantially flush with each other.

DESCRIPTION OF THE PREFERRED EMBODIMENTS

Figure 1:
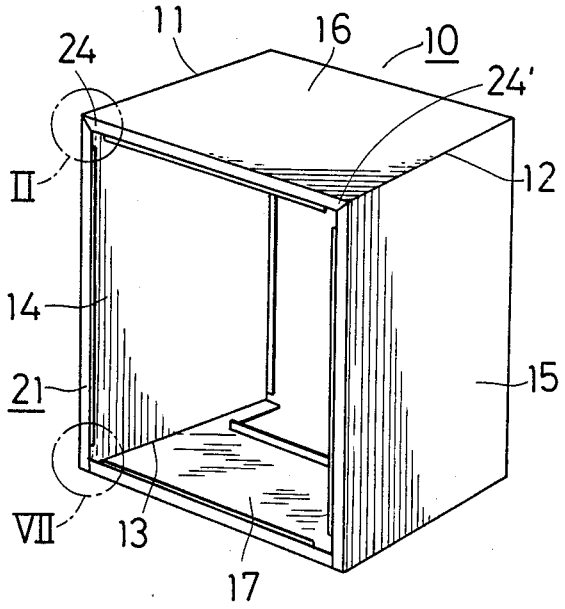
FIG. 1 is a perspective view showing one example of the main portion of an outer box used in a refrigerator cabinet embodying the concept of the present invention.
Figure 2:
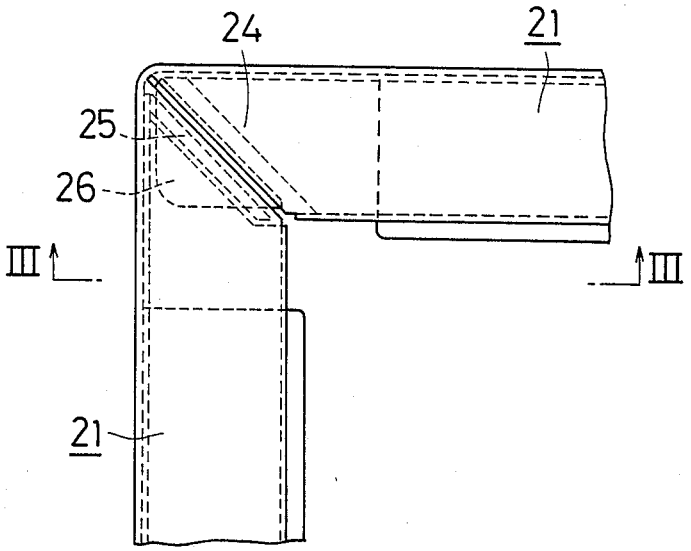
FIG. 2 an enlarged front elevation of the circular portion II of FIG. 1.
Figure 3:
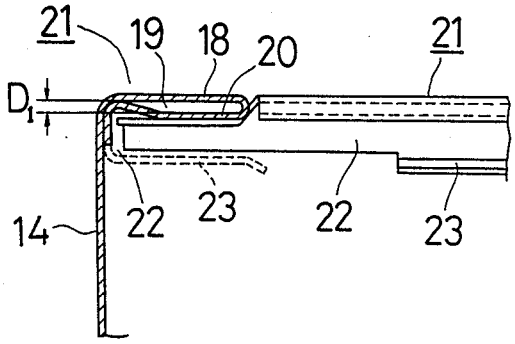
FIG. 3 is a cross-sectional view taken on the line III—III of FIG. 2.

Referring now to FIGS. 1–5, there is shown the main portion 10 of the outer box of a refrigerator embodying the concept of the present invention. The outer box (or shell) is made by blanking a flat steel sheet, coating at least its outside surface with paint and then bending the sheet at 11, 12 and 13 to form a left side wall 14, a right side wall 15, a top wall 16 and a bottom wall 17. Formed on the fringe of the outer box 10 surrounding the entrance to the box are front flange sections 21, each of which consists of a front flange 18 bent inwardly and a turnover flange 20 that is integral with the flange 18 and bent back so as to leave a slight space 19 between the flanges. Each rear flange 23 extends from the rear side of the turnover flange 20 parallel to the front flange 18, abuts on the inner walls comprised of the side walls 14 and 15, the top wall 16 and the bottom wall 17, and is bent inwardly to form a front fringe groove 22 for accommodating the fringe of an inner box (or liner) surrounding the entrance to the inner box.

When the turnover flange 20 is bent, the radius of curvature is required to be large enough to prevent cracking and peeling of the coating on the steel sheet forming the outer box 10. This necessitates the aforementioned space 19 between the flanges 18 and 20.

The coated steel sheet is preferably made of cold-rolled steel, and its thickness t is preferably in the range from 0.3 to 1.0 mm. The front flange and the turnover flange in each front flange section 21 are preferably spaced apart a distance $D_1$ in the range from 3t to 5t as in the space 19. Of course, the radius of curvature of the flanges is half of the distance $D_1$. These limitations imposed on the bending are primarily attributable to considerations given to paint and can be relaxed by heating upon bending operation. Paint such as polyester resin paint, polyvinylchloride resin paint, acrylic resin paint or other resin paints is applied to the steel sheet so as to form a coating in the order of 0.01–0.15 mm thickness by curtain flow coating, spray coating or roller coating. The coating operation can be effected before blanking the steel sheet as well as after the blanking, if the sheet is a single, substantially flat material as shown. If the coating is effected prior to the blanking, the steel sheet itself will be exposed as surfaces are formed by blanking. Accordingly, it is desired that appropriate anticorrosion treatment and decoration be made on the sheet.

The curtain flow coating can be effected with simpler facilities in a simpler manner resulting in a quite less rate of occurrence of substandard coating than electrostatic spray coating which is made on an outer box already assembled into a three-dimensional structure.

As shown in FIGS. 2–5, in a front flange overlapping portion 24 at each corner of the outer box 10 which is bent at 11 and 12, one front flange 18 on the side of a cut end is bent back at the same radius of curvature as the flange 20 along a predetermined line A—A inclined at an angle of 45° to form a turnover portion 25, also leaving a slight space $D_2$. The cut end portion of another front flange 18 which is to abut on the turnover portion 25 is stepped along the inclined lines B—B and C—C which are so set as to achieve the abutting on the turnover portion 25 when the end portion is bent at 11, thus forming a stepped portion 26. The dimension of the step of the stepped portion 26 is so set that the neighboring front flanges 18 are made substantially flush with each other when the turnover portion 25 is abutted.

Figure 5:
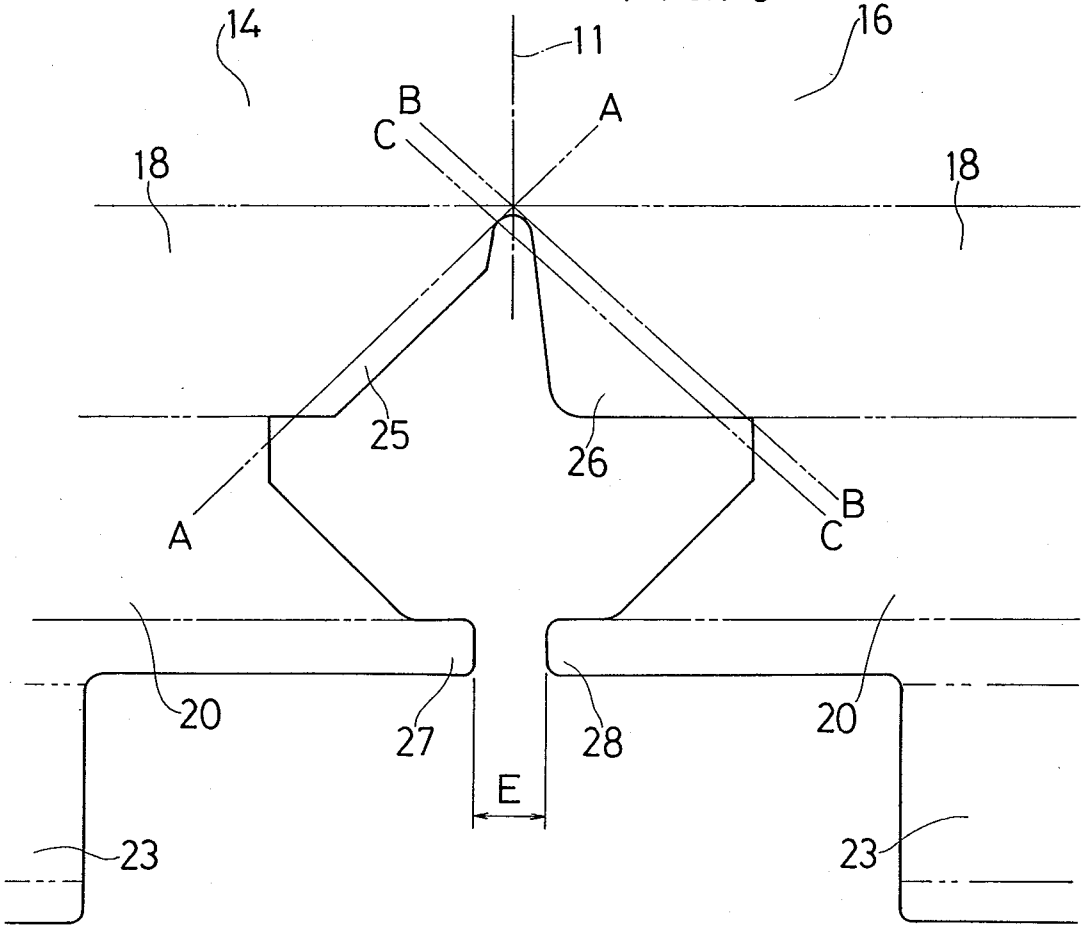
FIG. 5 is a fragmentary expansion plan of the outer box of FIG. 2.
Figures 6A, 6B, 6C, 6D:
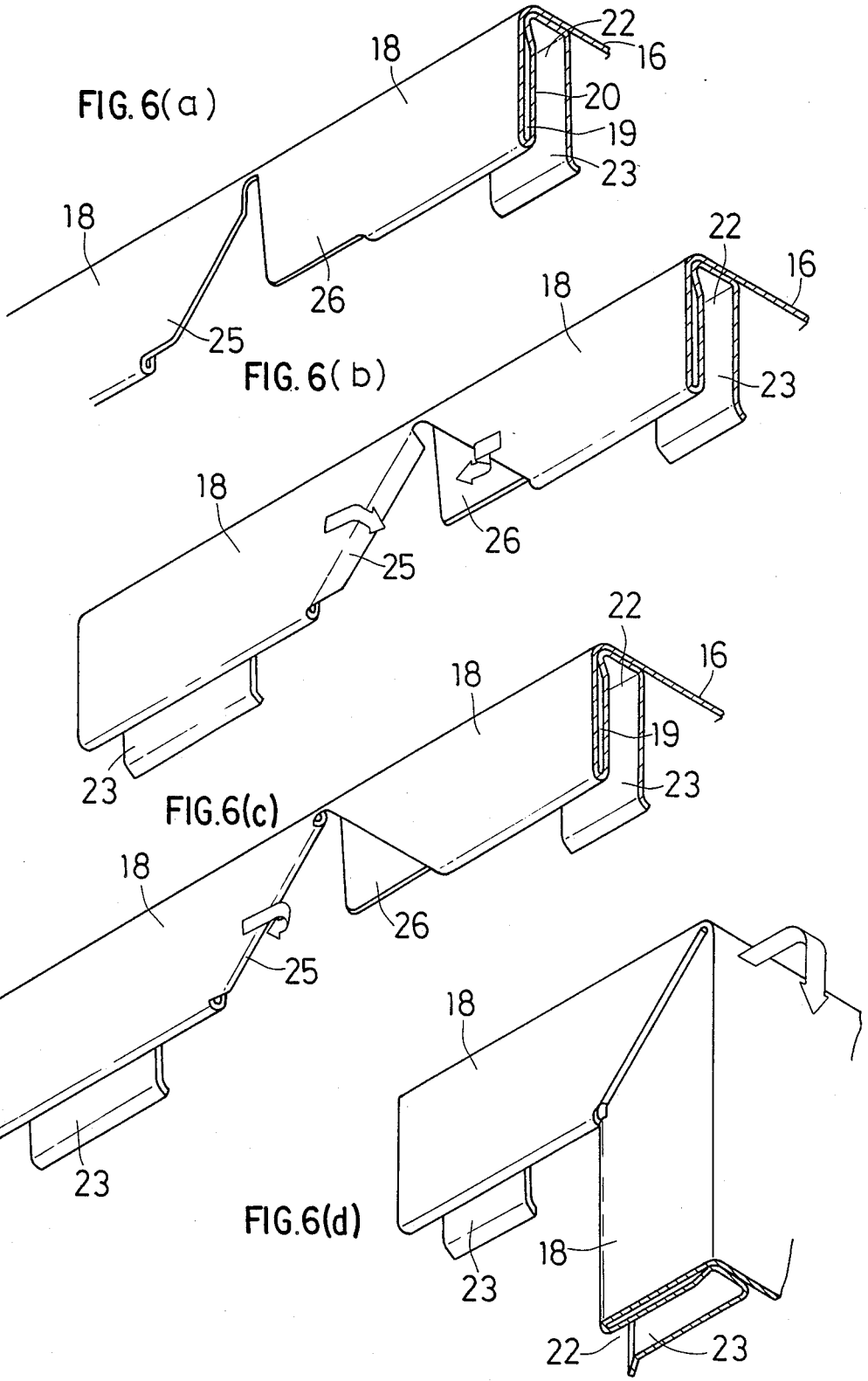
FIGS. 6(*a*)–6(*d*) are perspective views of the outer box for illustrating the sequence in which the box is bent.

Referring to FIGS. 6(*a*)–6(*d*), there is shown one practical example of manner in which the components are machined. Specifically, the blanked, coated steel sheet whose one corner 24 is shown in FIG. 5 in the form of an expansion plan is formed so as to have the front flanges 21 and rear flanges 23 as shown in FIG. 6(*a*) by a roll former or similar means. Thus, the front end grooves 22 for receiving the inner box is formed. Then, the front flanges 21 are partially cut out as shown in FIG. 6(*b*) and bent at 11 (FIG. 5). Thereafter, the front flanges are stepped and bent along the inclined lines B—B and A—A for abutting, so that stepped portion 26 on one side and turnover portion 25 on the opposite side are bent to an angle of about 90°. Then, the portion 25 bent to an angle of about 90° in the foregoing working is further bent to an angle of about 180° as shown in FIG. 6(*c*), forming the slight space $D_2$ similar to the space $D_1$ formed between the flanges 18 and 20. The flanged portions of the turnover portion 25 and the stepped portion 26 on the back side are cut out as shown in FIG. 5, and then bent to an angle of about 90° at 11 as shown in FIG. 6(*d*).

Figure 4:
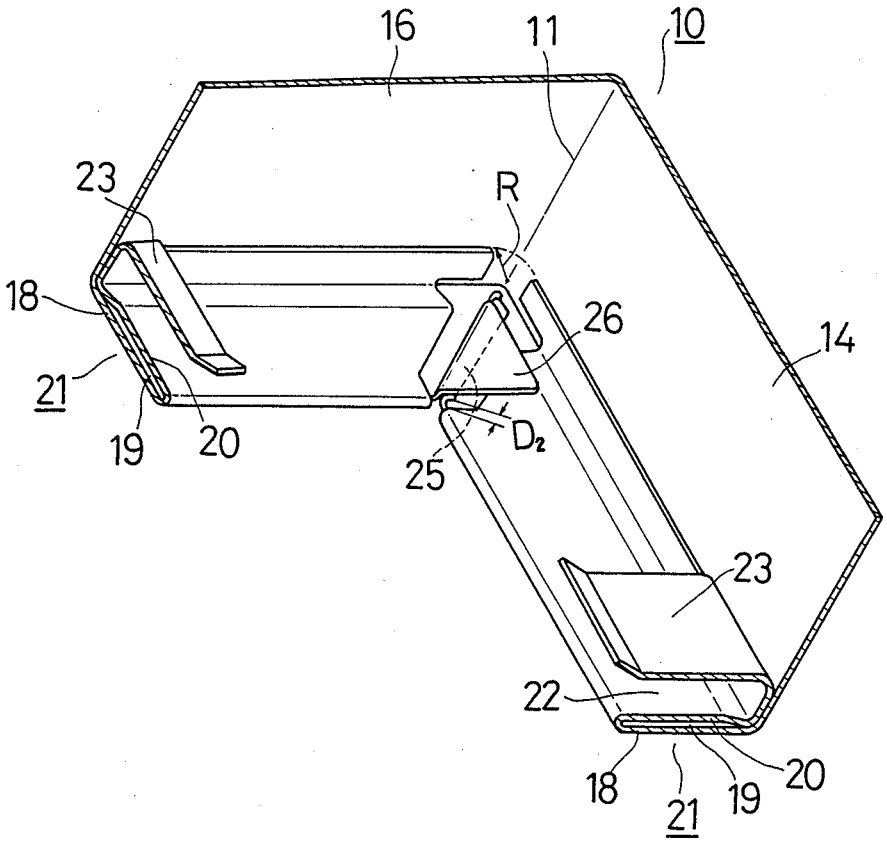
FIG. 4 is a fragmentary perspective view of the outer box of FIG. 2 as viewed from the back side.

The blanked structure shown in FIG. 5 has tongues 27 and 28, which are symmetrical with respect to the bending line 11 and lie on the bottom of the groove 22. The tongues abutting on the side walls 14, 15 and top wall 16 or bottom wall 17 act to add to the rigidity of the groove 22 and also to prevent blows from forming dents in the cut out portions when the structure is bent along the line 11. At this time, the two-dimensional space E between the tongues 27 and 28 extends to bent corner R along the line 11 as shown in FIG. 4.

When food is taken in and out of the refrigerator, the regions between the top wall 16 and the side walls 14, 15, especially the unsupported side of the door, are most conspicuous and, accordingly, the aforementioned structure is aesthetically advantageously adopted for the neighboring flanges 21 abutting on each other at the corners on the fringe of the outer box 10 surrounding the entrance to the box 10. However, the structure shown in FIG. 7 may sometimes be adopted for the bottom wall.

Figure 7:
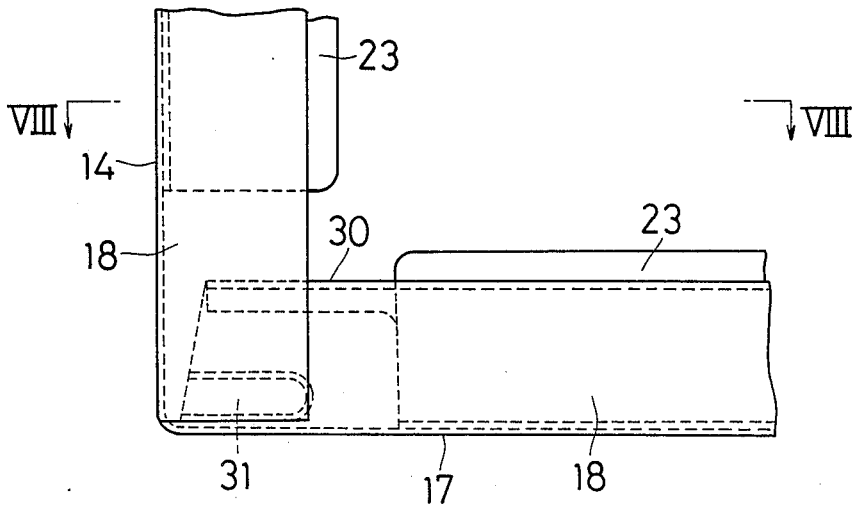
FIG. 7 is an enlarged front elevation of the circular portion VII of FIG. 1.
Figure 8:
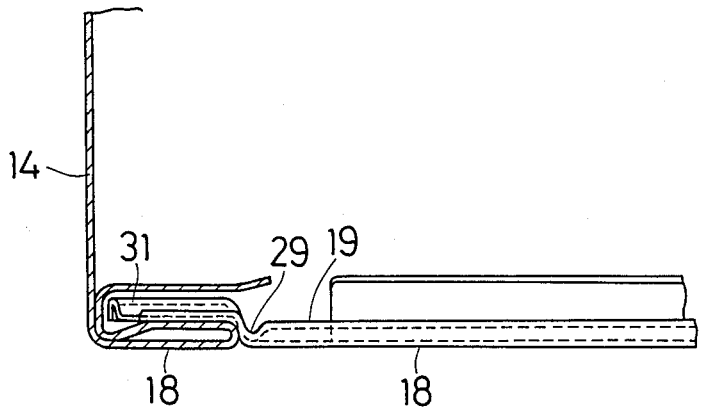
FIG. 8 is a cross-sectional view taken on the line VIII—VIII of FIG. 7.
Figure 9:
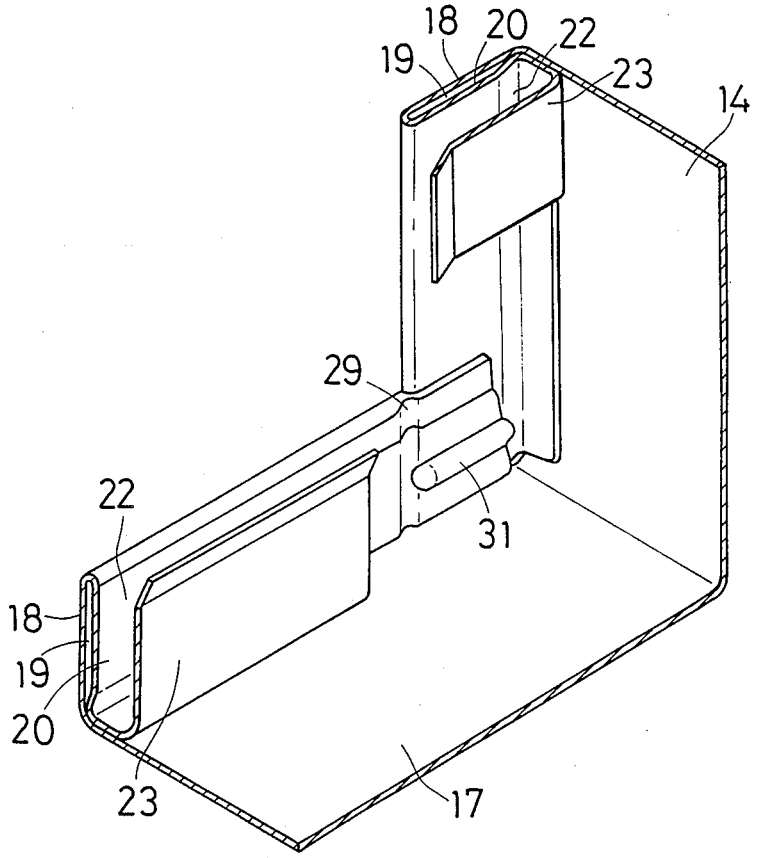
FIG. 9 is a fragmentary perspective view of the outer box of FIG. 7 as viewed from the back side.

In the structure shown in FIGS. 7 and 8, the front flanges 21 are overlapped each other rather than abutted on each other at the corners. The space 19 is formed between one front flange 18 and the turnover flange 23, and the turnover flange 19 is provided with a recession 29. Also, the other front flange 18 which is located on the back side of the one front flange 18 for preventing deformation of a ridgeline 30 of the other front flange 18 is provided with a recession 31 to absorb deformation.

Figure 10:
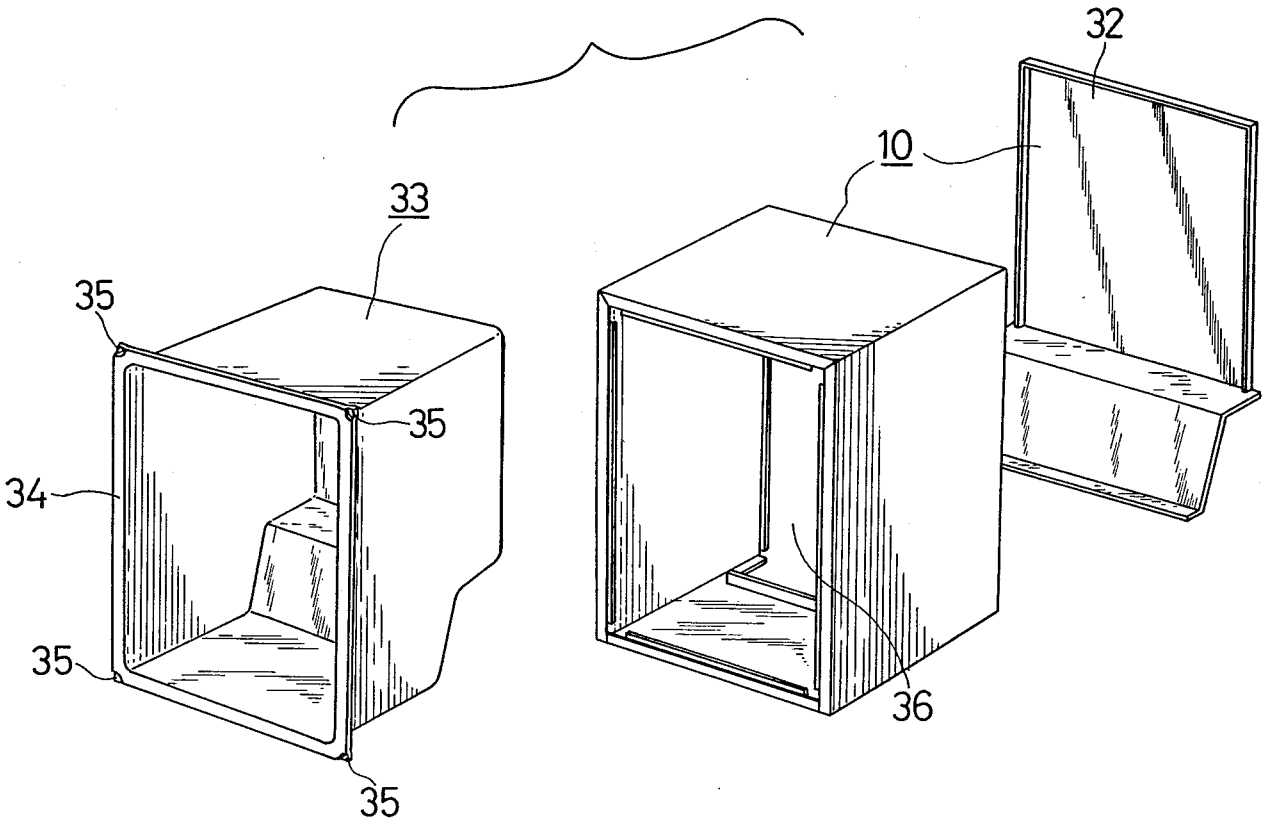
FIG. 10 is an exploded perspective view of the main portion of the outer box shown in FIG. 1, which constitutes the body of the cabinet of a refrigerator according to the present invention, a back plate that is also a component of the outer box, and an inner box.

Referring to FIG. 10, there is illustrated the manner in which the main components of the heat insulating cabinet using the outer box 10 are assembled, the box 10 being made of the coated steel sheet according to the invention. A rear plate 32 closes the rear side 36 of the opening in the main portion of the outer box 10. An inner box 33 is made of synthetic resin and has a flange 34 bending outwardly around its opening. The flange 34 is inserted in the front end grooves 22. The four corners of the flange 34 are each provided with a stepped portion 35 to set free the stepped portions 26 or the recessions 29 in the flange located in the grooves 22 of the outer box 10.

Figure 12:
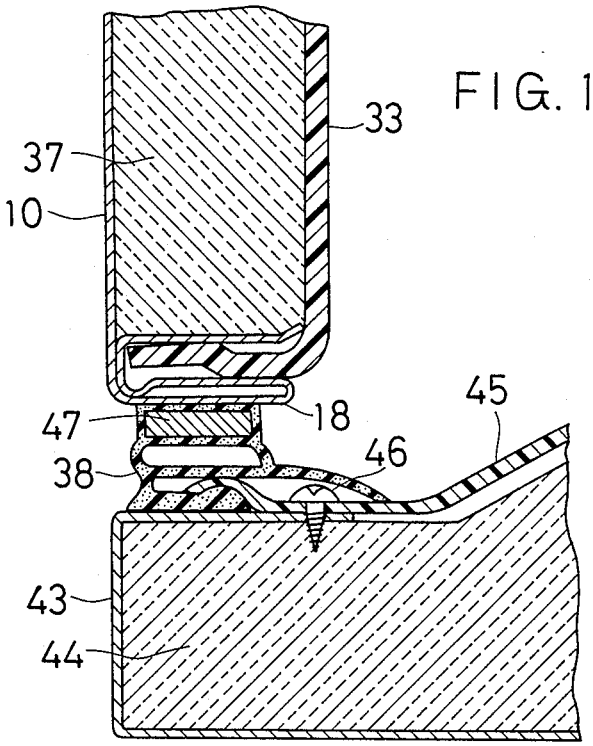
FIG. 12 is an end view taken on the line XII—XII of FIG. 11.

In assembling the cabinet, the inner box 33 is inserted in the outer box 10, resulting in a space between the boxes. Then, raw material of polyurethane foam resin in the form of liquid is injected into the space to form a heat insulating layer 37 as shown in FIG. 12, whereby the boxes 10 and 33 are united. At the same time, the expanding force of the foams urges the stepped portion 26 shown in FIG. 4 forward, bringing it into abutting engagement with the turnover portion 25. Thus, the upper corners 24 and 24' between the front flanges 18 are made flush with each other with greater accuracy, thus preventing formation of a gap between the door seal strip 38 and the flanges, thereby preventing cooled air from leaking.

Since the refrigerator cabinet is constructed as described above, the front flanges can be held in substantially flush condition by overlapping the turnover portion and the stepped portion at the abutting portions of the front flange corners. Further, when the flange of the inner box is inserted in the front end grooves, an appropriate pressing force is exerted on the flange, whereby the front flanges can be made flush with greater accuracy.

In addition, because the abutting portions at the corners overlap each other along the inclined line, the flat, coated portion of the stepped portion which is coated with the same paint as the surface of the front flanges is laid open to view even if a slight gap is formed between neighboring abutting portions. Consequently, no aesthetical problem will be raised and so the favorable, beautiful appearance can be maintained.

In this way, the corner pieces conventionally used in the neighboring abutting corners of front flanges can be omitted, leading to a decrease in the manufacturing cost and also to an increase in the efficiency of assembly operation.

Furthermore, such surfaces that are formed by cutting, piercing and similar operations and that can be exposed to the human eye after the structure is assembled into a box-like construction are flat and coated after machining, and therefore anticorrosive treatment is dispensed with.

Figure 11:
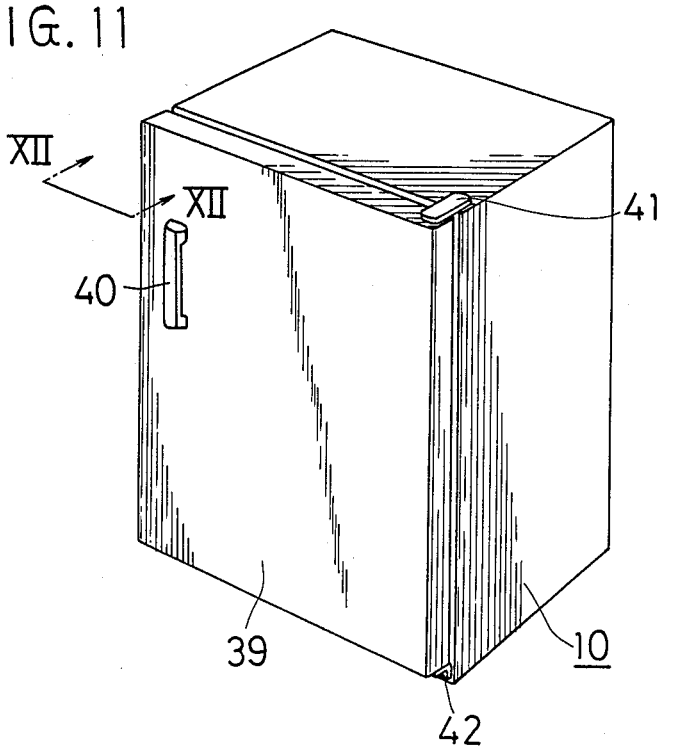
FIG. 11 is a perspective view of one example of the refrigerator cabinet according to the invention which uses the components of FIG. 10.

In FIGS. 11 and 12, the cabinet includes a heat insulating door 39, a handle 40 fixed to the door, an upper hinge 41, a lower hinge 42, the body 43 of the door, heat insulating layer 44, a door panel 45, a screw 46 for securing the door panel to the door body, and a magnet 47 in the seal strip 38.

What is claimed is:

1. An improved refrigerator cabinet of the type wherein an inner enclosure is mounted inside an outer housing, said outer housing comprising:

a top wall and side walls integrally formed from a single bent metal sheet;

a top front flange connected to said top wall along a front edge of said top wall, said flange being bent inwardly and substantially perpendicularly to said top wall; and side front flanges connected to said side walls along front edges of said side walls, respectively, said flanges being bent inwardly and substantially perpendicularly to said side walls, said top front flange being substantially adjacent to said side front flanges at upper corners of said outer housing;

turnover flange portions, each connected to a respective front flange, each said turnover flange portion being bent substantially behind said respective front flange;

rear-bent flange portions, each connected to a respective turnover flange portion, bent rearwardly so as to extend rearwardly from said turnover flange portions and substantially parallel to said respective top and side walls;

each rear-bent flange portion having a free edge portion, said free edge portions being bent inwardly so as to be substantially parallel and in spaced relationship to said turnover flange portion so as to define therebetween a space for receiving an outer front fringe extending around the front periphery of said inner enclosure when said inner enclosure is mounted in said outer housing;

one of said front flanges at an upper corner partially overlapping its adjacent front flange, said overlapping flange further comprising:

a corner rear-bent portion bent substantially behind said overlapping front flange along a reference line inclined at a predetermined angle with respect to horizontal, said line extending from said corner inwardly in substantially the plane of said front flange, said corner rear-bent portion leaving a predetermined space between said corner rear-bent portion and said front flange;

said overlapped front flange adjacent to said overlapping front flange further comprising:

a stepped portion connected to said overlapped front flange substantially along said reference line, said stepped portion extending from said overlapped front flange substantially parallel to and behind said overlapping front flange, said stepped portion extending across and substantially obstructing a gap between said overlapping and overlapped front flanges at said upper corner, said gap extending between said flanges along said inclined reference line, and further so as to maintain said front flanges substantially flush with one another.

2. An improved refrigerator cabinet according to claim 1 further comprising:

a heat insulating door attached to the outer housing, and a door sealing strip attached to the door for coming into sealing engagement with the substantially flush front flanges of the outer housing.

3. An improved refrigerator cabinet as set forth in claim 2, wherein the metal sheet is a steel sheet.

4. An improved refrigerator cabinet as set forth in claim 3, wherein the steel sheet is a cold-rolled steel sheet having a thickness of 0.3–1.0 mm.

5. An improved refrigerator cabinet as set forth in claim 4, wherein the first and second predetermined spaces each take a dimension in the range from three to five times the thickness of the sheet.

6. An improved refrigerator cabinet as set forth in claim 1, wherein there is a heat insulating layer between the outer housing and the inner enclosure.

7. An improved refrigerator cabinet as set forth in claim 6, wherein the heat insulating layer is an expanded layer of polyurethane resin which is integrally formed by injecting a liquid form of said resin into the space between the outer housing and the inner enclosure.

8. An improved refrigerator cabinet as set forth in claim 1, wherein the reference line is inclined at an angle of substantially 45° to horizontal.

9. An improved refrigerator cabinet as set forth in claim 1, wherein the metal sheet is coated with paint before it is blanked.

10. An improved refrigerator cabinet as set forth in claim 1, wherein the metal sheet is coated with paint after it is blanked.

* * * * *